US009531111B2

(12) United States Patent
Chen et al.

(10) Patent No.: US 9,531,111 B2
(45) Date of Patent: Dec. 27, 2016

(54) AUDIO JACK CONNECTOR WITH A SEALING ASSEMBLY ASSEMBLED ON AN INSULATIVE HOUSEING

(71) Applicant: FOXCONN INTERCONNECT TECHNOLOGY LIMITED, Grand Cayman (KY)

(72) Inventors: Ding-Cherng Chen, New Taipei (TW); Min-Han Lin, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/734,269

(22) Filed: Jun. 9, 2015

(65) Prior Publication Data

US 2015/0357745 A1 Dec. 10, 2015

(30) Foreign Application Priority Data

Jun. 9, 2014 (CN) ..... 2014 1 0250954

(51) Int. Cl.
*H01R 24/00* (2011.01)
*H01R 13/52* (2006.01)
(Continued)

(52) U.S. Cl.
CPC ..... *H01R 13/5202* (2013.01); *H01R 13/5213* (2013.01); *H01R 24/58* (2013.01);
(Continued)

(58) Field of Classification Search
CPC . H01R 24/58; H01R 2103/00; H01R 2107/00; H01R 2105/00; H04Q 1/142
(Continued)

(56) References Cited

U.S. PATENT DOCUMENTS 1,901,040 A * 3/1933 Peroni ..... H01R 24/58 200/51.09
2,727,216 A * 12/1955 Sussman ..... H01R 24/58 174/50.5
(Continued)

FOREIGN PATENT DOCUMENTS

CN 201797146 U 4/2011
TW M442613 U1 12/2012
TW M454006 U1 5/2013

*Primary Examiner* — Chandrika Prasad
*Assistant Examiner* — Vladimir Imas
(74) *Attorney, Agent, or Firm* — Wei Te Chung; Ming Chieh Chang

(57) ABSTRACT

An audio jack connector including: an insulative housing including a mounting face, a receiving space, an insertion opening communicating with the receiving space, and a number of passageways extending from the mounting face along a bottom-to-up direction, a through hole defined in each of the passageways and communicating to the receiving space; a number of contacts retained in corresponding passageways and extending into the receiving space through the through holes; and a sealing assembly assembled on the mounting face, the sealing assembly including a gasket covering on the mounting face for sealing the passageways and a cover assembled with the gasket to press and hold the gasket, the gasket having a number of passing holes exposing a soldering end of each of the contacts.

18 Claims, 6 Drawing Sheets

(51) Int. Cl.
*H01R 24/58* (2011.01)
*H01R 107/00* (2006.01)
*H01R 12/70* (2011.01)
*H01R 12/72* (2011.01)

(52) U.S. Cl.
CPC ..... *H01R 12/707* (2013.01); *H01R 12/722* (2013.01); *H01R 2107/00* (2013.01)

(58) Field of Classification Search
USPC ..... 439/668, 669, 686, 689
See application file for complete search history.

(56) References Cited

U.S. PATENT DOCUMENTS 3,341,745 A * 9/1967 Munro ..... H01R 13/68 361/630
3,372,367 A * 3/1968 Concannon ..... H01R 24/58 439/864
3,445,585 A * 5/1969 Bock ..... H04Q 1/142 174/59
4,002,399 A * 1/1977 Deitch ..... H01R 24/58 439/638
4,165,147 A * 8/1979 Buck ..... H01R 24/58 439/188
4,479,691 A * 10/1984 Smith, Jr. ..... H01R 13/422 439/271
4,512,619 A * 4/1985 Dechelette ..... H01R 9/053 439/276
4,659,167 A * 4/1987 Masuda ..... H01H 11/00 439/668
5,828,807 A * 10/1998 Tucker ..... G02B 6/4441 385/135
5,909,155 A * 6/1999 Anderson ..... H01R 24/542 333/100
5,984,727 A * 11/1999 Wu ..... H01R 13/65802 439/607.02
6,010,348 A * 1/2000 Alden ..... H01R 13/506 439/274
6,049,709 A * 4/2000 Anderson ..... H01R 24/50 348/E7.053
6,056,602 A * 5/2000 Wu ..... H01R 13/641 439/668
6,093,058 A * 7/2000 Wu ..... H01R 24/58 439/607.35
6,592,408 B2 * 7/2003 Ma ..... H01R 23/6873 439/607.28
6,595,804 B2 * 7/2003 Nagata ..... H01R 24/58 439/668
6,692,267 B1 * 2/2004 Schmukler ..... G01R 31/2808 439/76.1
6,767,256 B1 * 7/2004 Faerber ..... H01R 24/58 439/668
6,835,080 B1 * 12/2004 Chang ..... H01R 13/7031 439/188
6,869,315 B2 * 3/2005 Nakai ..... H01R 24/40 439/668
7,107,034 B2 * 9/2006 Davis ..... H01P 1/047 174/68.1
7,637,787 B2 * 12/2009 Chien ..... H01R 24/58 439/668
7,728,226 B2 * 6/2010 Drane ..... H01H 21/085 174/66
7,736,191 B1 * 6/2010 Sochor ..... A61N 1/3752 439/668
7,848,100 B2 * 12/2010 Wayman ..... H04Q 1/142 248/200
7,922,535 B1 * 4/2011 Jiang ..... H01R 13/5205 439/271
8,123,569 B2 * 2/2012 Little ..... H01R 13/52 439/669
8,678,863 B2 * 3/2014 Nagata ..... H01R 13/5213 439/606
8,922,985 B2 * 12/2014 Richardson ..... G06F 1/1626 206/320
8,951,073 B2 * 2/2015 Zhang ..... H01R 13/41 439/676
9,219,330 B2 * 12/2015 Shin ..... H01R 13/60
9,281,595 B2 * 3/2016 Namjoshi ..... H01R 13/113
2009/0011656 A1 * 1/2009 Dal Pra' ..... B62J 6/18 439/669
2011/0014815 A1 * 1/2011 Zhu ..... H01R 24/58 439/620.21
2011/0195611 A1 * 8/2011 Little ..... H01R 13/52 439/668
2011/0237103 A1 * 9/2011 Harlan ..... H01R 13/2414 439/271
2012/0051015 A1 * 3/2012 Dabov ..... G06F 1/1656 361/760
2013/0065445 A1 * 3/2013 Nagata ..... H01R 13/5213 439/625
2013/0244497 A1 * 9/2013 Zhang ..... H01R 13/64 439/676

* cited by examiner

AUDIO JACK CONNECTOR WITH A SEALING ASSEMBLY ASSEMBLED ON AN INSULATIVE HOUSEING

BACKGROUND OF THE INVENTION

1. Field of the Invention

The present invention relates generally to an audio jack connector, and more particularly to an audio jack connector comprising a sealing assembly assembled on an insulative housing thereof.

2. Description of Related Arts

An audio jack connector is usually arranged on an electronic device and an audio plug connector is inserted into the audio jack connector for signal transmission.

China Patent No. 201797146 discloses an electrical connector comprising an insulating body and conducting terminals fixed onto the insulating body. The insulating body includes a containing space, a mounting surface, terminal slots, and a flexible sealing piece covering the mounting surface to seal the terminal slots in order to realize waterproof and dust-proof effects. But since the sealing piece is not positively pressed in place, it is easy to deform and be separated from the insulating body.

Hence, an audio jack connector having an improved sealing assembly assembled on insulative housing is desired.

SUMMARY OF THE INVENTION

Accordingly, an object of the present invention is to provide an audio jack connector having an improved sealing assembly assembled on insulative housing.

To achieve the above object, an audio jack connector in accordance with the present invention comprises: an insulative housing comprising a mounting face, a receiving space, an insertion opening communicating with the receiving space, and a plurality of passageways extending from the mounting face along a bottom-to-up direction, a through hole defined in each of the passageways and communicating to the receiving space; a plurality of contacts retained in corresponding passageways and extending into the receiving space through the through holes; and a sealing assembly assembled on the mounting face, the sealing assembly comprising a gasket covering on the mounting face for sealing the passageways and a cover assembled with the gasket to press and hold the gasket, the gasket having a plurality of passing holes exposing a soldering end of each of the contacts.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
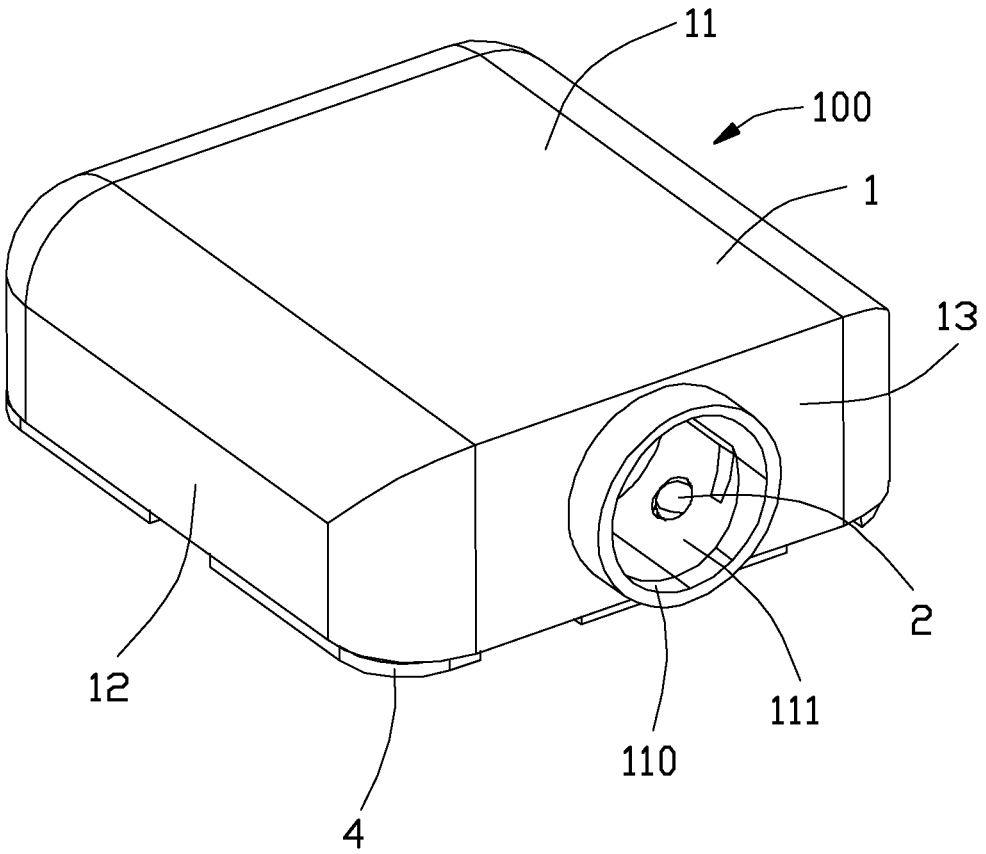
FIG. 1 is a perspective, assembled view of an audio jack connector in accordance with a preferred embodiment of the present invention.
Figure 2:
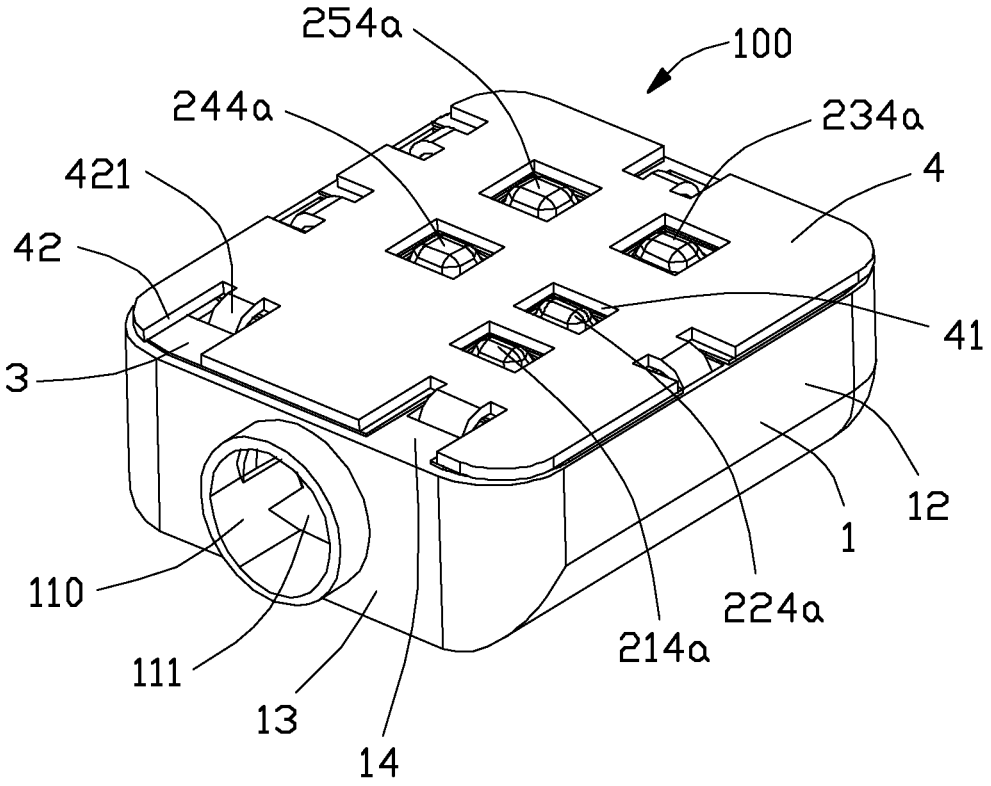
FIG. 2 is a perspective, assembled view of the audio jack connector similar to FIG. 1, but taken from a different aspect.
Figure 3:
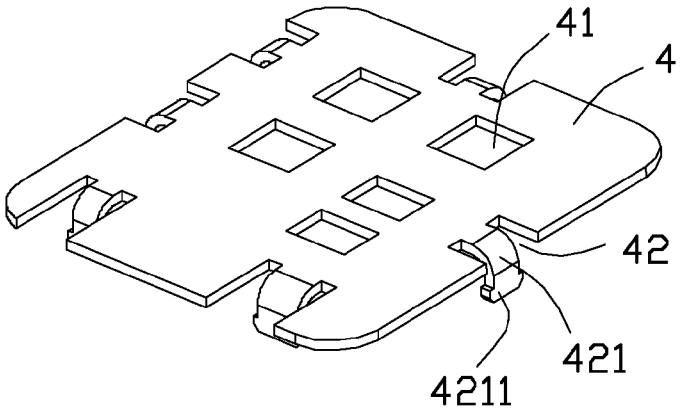
FIG. 3 is a perspective, exploded view of the audio jack connector show in FIG. 1.
Figure 3:
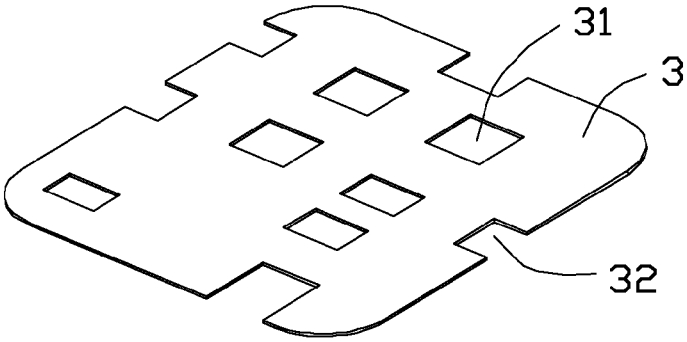
Figure 3:
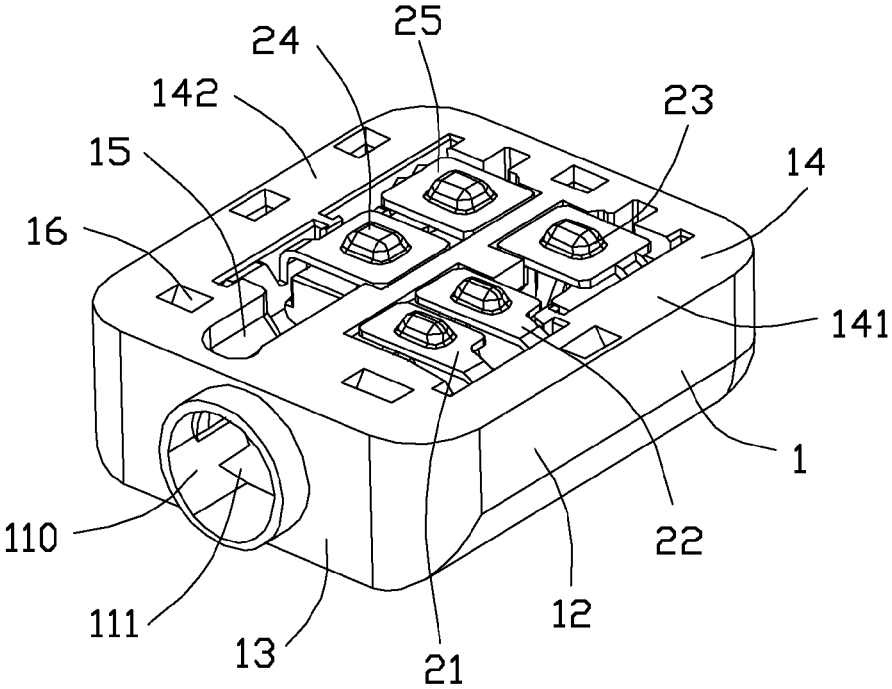

Referring to FIGS. 1 to 3, an audio jack connector 100 is assembled in an electrical device as an Input/output interface for connecting with an audio plug. The audio jack connector 100 comprises an insulative housing 1, a plurality of contacts 2 retained in the insulative housing 1 and a sealing assembly assemble to the insulative housing 1. The insulative housing 1 defines a mounting face 14. The sealing assembly includes a gasket 3 covering on the mounting face 14, and a fixing cover 4 covering on the gasket 3 and fixed to the insulative housing 1.

Referring to FIGS. 1 to 3, the insulative housing 1, the gasket 3 and the fixing cover 4 are made of insulating material. The insulative housing 1 includes a top wall 11, two opposite side walls 12 perpendicular to the top wall 11 and connected with the top wall 11 smoothly, two opposite side walls 13 perpendicular to the top wall 11 and connected with the top wall 11 smoothly, and the mounting face 14 connected with the side walls 12 and side wall 13 and parallel to the top wall 11. A receiving space 111 is defined in the insulative housing 1 for receiving an audio plug connector (not shown), the receiving space 111 is extended from a side wall 13 to a rear end of the insulative housing 1. An insertion opening 110 is communicated with the receiving space 111 for guiding the audio plug connector. The mounting face 14 includes a first side 141 and a second side 142 opposite to the first side 141.

Figure 4:
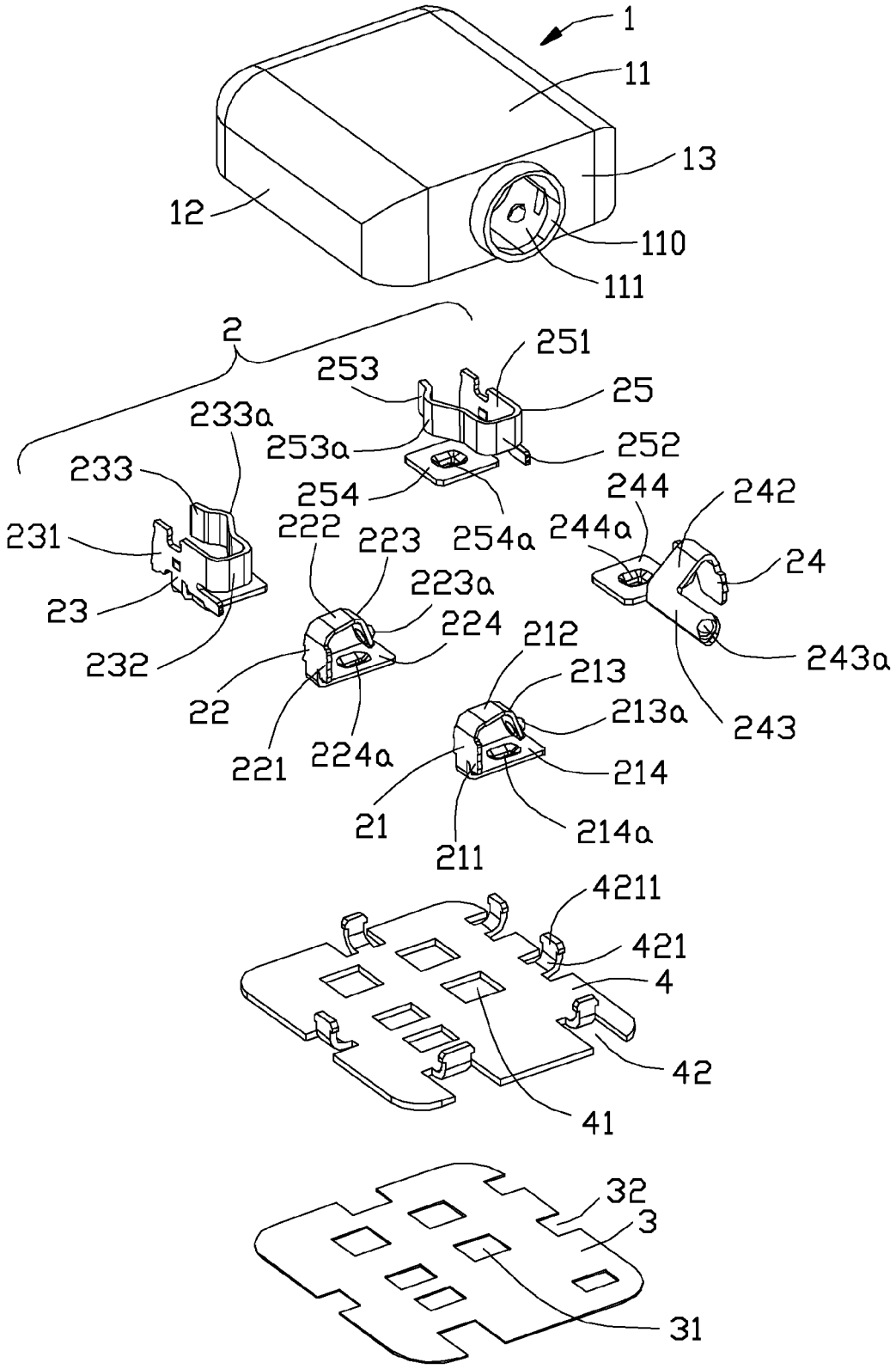
FIG. 4 is a perspective, further exploded view from FIG. 3, in which five electrical contacts are separated from other parts thereof for ease of description.
Figure 5:
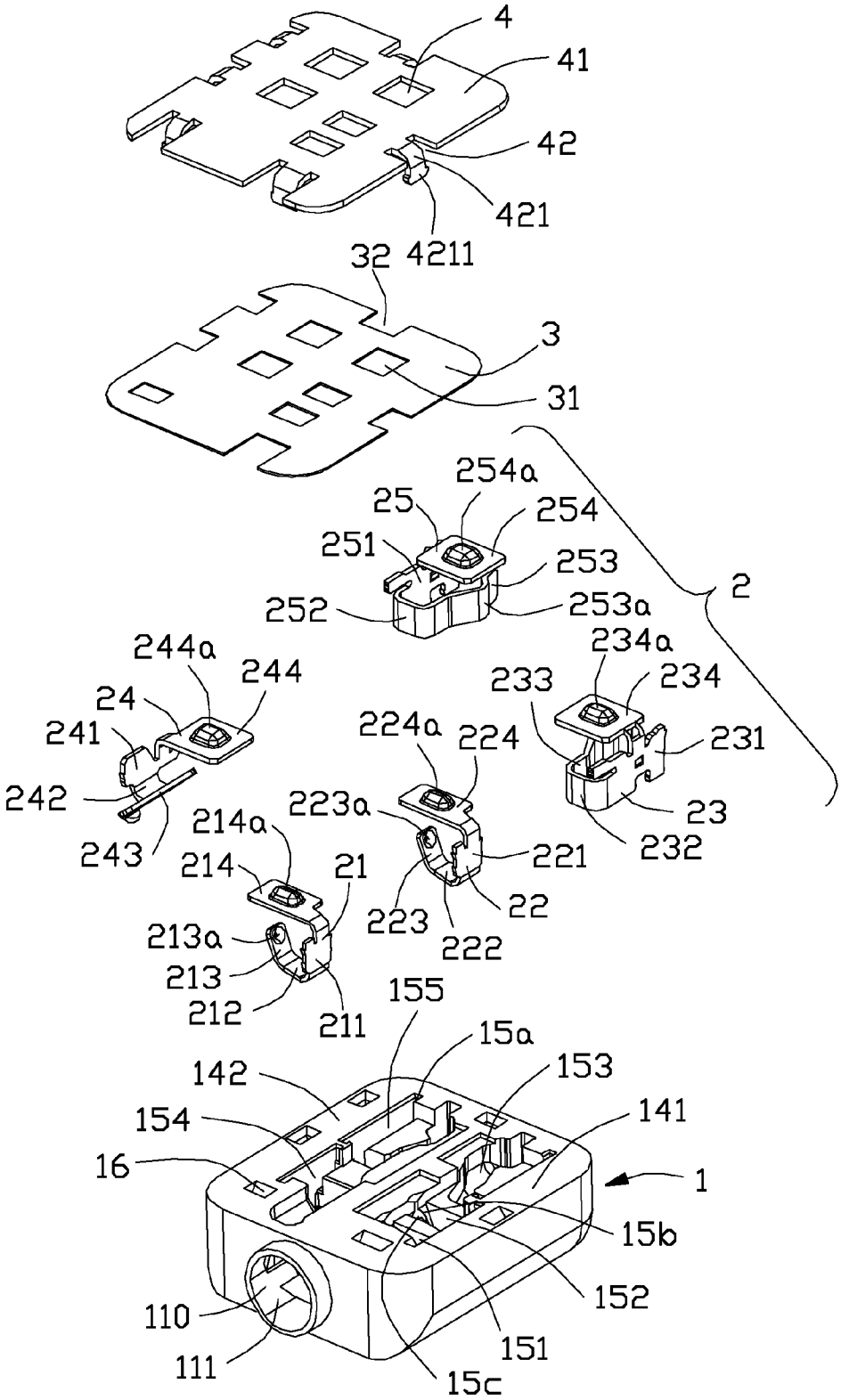
FIG. 5 is a view similar to FIG. 4, but taken from a different aspect.
Figure 6:
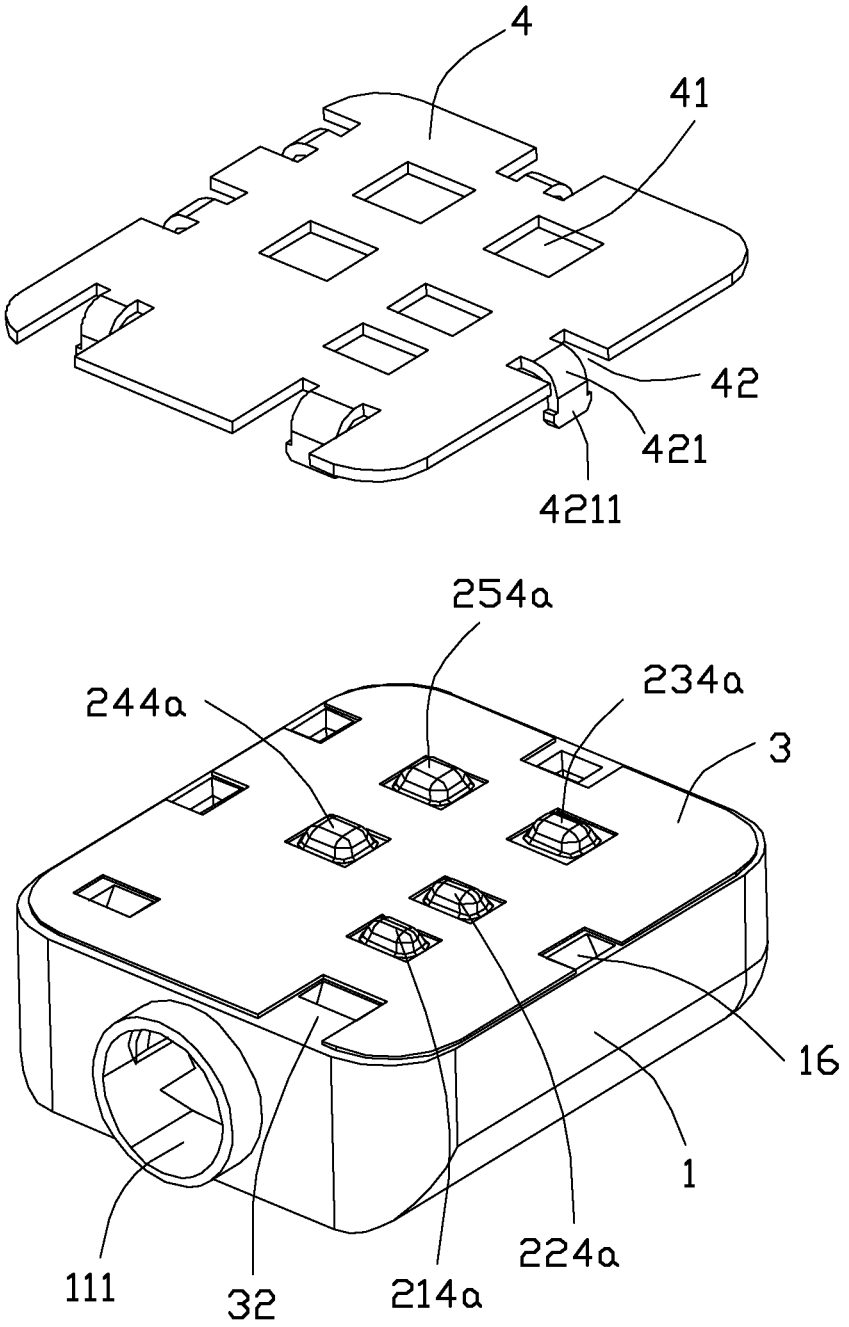
FIG. 6 is a perspective, partial assembled view of the audio jack connector show in FIG. 3.

Referring to FIGS. 3 to 5, a number of passageways 15 communicating with the receiving space 111 are extended from the mounting face 14 into the insulative housing 1. The passageways 15 includes a first contact passageway 151, a second contact passageway 152, a third contact passageway 153, a fourth contact passageway 154 and a fifth contact passageway 155. The first contact passageway 151, the second contact passageway 152 and the third contact passageway 153 locates on the first side 141 of the mounting face 14. The fourth contact passageway 154 and the fifth contact passageway 155 locates on the second side 142 of the mounting face 14. Each of the passageways 15 includes a fixing portion 15*a*, a moving portion 15*b* and through hole 15*c*. Each of the passageways 15 is communicated with the receiving space 111 through the corresponding through hole 15*c*. A number of fixing slots 16 are defined on the edges of mounting face 14.

Referring to FIGS. 4 to 5, the contacts 2 include a first contact 21, a second contact 22, a third contact 23, a fourth contact 24 and a fifth contact 25. The first contact 21, the second contact 22 and the third contact 23 are installed into the passageways 15 located on the first side 141 respectively. The fourth contact 24 and the fifth contact 25 are installed into the passageways 15 located on the second side 142.

Referring to FIGS. 3 to 5, the first contact 21 is inserted into the first contact passageway 151 from the mounting face 14. The first contact 21 includes a sheet-like main portion 211, a connecting portion 212 inwardly extended from a top end of the first portion 211, a contact portion 213 downwardly extended from the connecting portion 212 and a soldering portion 214 inwardly extended form a bottom end of the main portion 211. The main portion 211 is interference fit into the fixing portion 15*a* of the first contact passageway 151 while the connecting portion 212 is received in the moving portion 15*b* of the passageway 15. The connecting portion 212 is curved so as to form a leaf spring to provide retaining force. A protrusion portion 213*a* is defined on a inside wall of the contact portion 213 and extends into the receiving space 111 through the through hole 15*c* to connect with the mating plug. A bottom surface of the soldering portion 214 is not extended beyond the mounting face 14 but parallel to the mounting face 14. A soldering pin 214*a* downwardly extended beyond the mounting face 14 is defined on the bottom surface of the soldering portion 214.

Referring to FIGS. 3 to 5, the second contact 22 is similar to the first contact 21. The second contact 22 is installed into the second contact passageway 152. The second contact 22 includes a sheet-like main body 221, a connecting portion 222 inwardly extending from a top end of the main portion 221, a contact portion 223 downwardly extending from the connecting portion 222, and a soldering portion 224 inwardly extending from a bottom end of the main portion 221. The main portion 221 is interference fit into the fixing portion 15*a* of the passageway 15 to fix the second contact 22 in the second contact passageway 152. The connecting portion 222 is received in the moving portion 15*b* of the passageway 15, and the connecting portion 222 is curved so as to form a leaf spring to provide retaining force. A protrusion portion 223*a* is defined on a inside wall of the contact portion 223 and extends into the receiving space 111 through the through hole 15*c* to connect with the mating plug. A bottom surface of the soldering portion 224 is not extended beyond the mounting face 14 but parallel to the mounting face 14. A soldering pin 224*a* downwardly extending beyond the mounting face 14 is defined on the bottom surface of the soldering portion 224.

Referring to FIGS. 3 to 5, the third contact 23 is installed into the third contact passageway 153. The third contact 23 includes a sheet-like main portion 231, a connecting portion 232 is inwardly extended form a front end of the main portion 231 and backwardly bent, a contact portion 233 continually backwardly extended from the connecting portion 232 and a soldering portion 234 inwardly extended from a bottom end of the main portion 231. The main portion 231 is interference fit in the fixing portion 15*a* to fix the third contact 23 in the third contact passageway 153. The connecting portion 232 is received in the moving portion 15*b*, and the connecting portion 232 is curved so as to form a leaf spring to provide retaining force. A protrusion portion 233*a* is defined on a inside wall of the contact portion 233 and extends into the receiving space 111 through the through hole 15*c* to connect with the mating plug. A bottom surface of the soldering portion 234 is not extended beyond the mounting face 14 but parallel to the mounting face 14. A soldering pin 234*a* downwardly extending beyond the mounting face 14 is defined on the bottom surface of the soldering portion 234.

Referring to FIGS. 3 to 5, the fourth contact 24 is installed into the fourth contact passageway 154. The fourth contact 24 includes a sheet-like main body 241, a connecting portion 242 inwardly extended from a top end of the main portion 241, a contact portion 243 downwardly extended from the connecting portion 242, and a soldering portion 244 inwardly extended form a bottom end of the main portion 241. The main portion 241 is interference fit into the fixing portion 15*a* of the passageways 15 to fix the first contact 24 in the fourth contact passageway 154. The connecting portion 242 is received in the moving portion 15*b* of the passageway 15, and the connecting portion 242 is curved so as to form a leaf spring to provide retaining force. A protrusion portion 243*a* is defined on a inside wall of the contact portion 243 and extends into the receiving space 111 through the through hole 15*c* to connect with the mating plug. A bottom surface of the soldering portion 244 is not extended beyond the mounting face 14 but parallel to the mounting face 14. A soldering pin 244*a* downwardly extending beyond the mounting face 14 is defined on a bottom surface of the soldering portion 244.

Referring to FIGS. 3 to 5, the fifth contact 25 is installed into the fifth contact passageway 155. The fifth contact 25 includes a sheet-like main portion 251, a connecting portion 252 is inwardly extended form a front end of the main portion 251 and backwardly bent, a contact portion 253 continually backwardly extended from the connecting portion 252 and a soldering portion 254 inwardly extended from a bottom end of the main portion 251. The main portion 251 is interference fit in the fixing portion 15*a* to fix the third contact 25 in the third contact passageway 155. The connecting portion 252 is received in the moving portion 15*b*, and the connecting portion 252 is curved so as to form a leaf spring to provide retaining force. A protrusion portion 253*a* is defined on a inside wall of the contact portion 253 and extends into the receiving space 111 through the through hole 15*c* to connect with the mating plug. A bottom surface of the soldering portion 254 is not extended beyond the mounting face 14 but parallel to the mounting face 14. A soldering pin 254*a* downwardly extending beyond the mounting face 14 is defined on the bottom surface of the soldering portion 254.

Referring to FIGS. 3 to 6, the outer contour of gasket 3 is essentially similar to the outer contour of the mounting face 14, and the gasket 3 is of a sheet-like structure. A number of passing holes 31 corresponding to the soldering pins 214*a*, 224*a*, 234*a*, 244*a*, 254*a* are respectively defined on a intermediate region of the gasket 3. The shape of each passing hole 31 is consistent with the circumferential edge contour of the soldering pin 214*a*, 224*a*, 234*a*, 244*a*, 254*a* respectively. The gasket covers the mounting face 14 while the soldering pins 214*a*, 224*a*, 234*a*, 244*a*, 254*a* extend through the corresponding passing holes 31 so that the gasket 3 seals the passageways 15 and makes the passageways 15 only communicate with the receiving space 111 to not affect the soldering effect of the pins 214*a*, 224*a*, 234*a*, 244*a*, 254*a*. A number of avoiding holes 32 are defined on the gasket 3 corresponding to the fixing slots 16, thus the fixing slots 16 can be exposed through the gasket 3. In the present embodiment, the gasket 3 may be a sided tape or a soft cushion made of chloroprene rubber, isobutene rubber, Pi-Pi, polyurethane or other waterproof material. Notably and understandably, the gasket 3 is deformed/deformable in the vertical direction when the fixed cover 4 is fixed to the insulative housing 1 due to its materiality.

Referring to FIGS. 4 to 5, the outer contour of cover 4 is essentially similar to the outer contour of the mounting face 14. The cover 4 is of a sheet-like structure. The cover 4 is made of rigid elastically deformable material. A number of passing hole 41 corresponding to the soldering pins 214*a*, 224*a*, 234*a*, 244*a*, 254*a* are respectively defined on the cover 4. The shape of each passing holes 41 is consistence with the circumferential edge contour of the corresponding soldering pins 214*a*, 224*a*, 234*a*, 244*a*, 254*a* respectively. A number of U-shape gaps 42 corresponding to the avoiding holes 32 are inwardly defined form the edges of the cover 4. A latching member 421 is upwardly extended form an inside edge of the U-shape gap 42. A snap 4211 is formed on a top end of the latching member 421. The cover 4 covers on the gasket 3, and the soldering pins 214*a*, 224*a*, 234*a*, 244*a*, 254*a* are exposed through the corresponding passing holes 41 to solder with the corresponding solder pads on a printed circuit board, so that the respective contacts 2 are electrically connected to the circuit board. The latching members 421 are passed through the corresponding U-shape gaps 42 and avoiding holes 32 to fix into the fixing slots 16 of the insulative housing 1. Thus, the cover 4 tightly overlies on the vertically deformed gasket 3 and then efficiently seals the passageways 15 of the insulative housing 1.

The audio jack connector 100 of the present invention defines a receiving space 111 having a one side opening, the passageways 15 are communicated with the receiving space 11 through the corresponding through hole 15*c* thereof, the gasket 3 covers on the mounting face 14 and the cover 4 tightly overlies on the gasket 3, the gasket 3 together with the cover 4 seals the passageways 15 of the insulative housing 1. In this way, even at great water pressure, the audio connector assembly 100 also achieves better water effects, and is easy to install, has low cost. Because each soldering pins 214*a*, 224*a*, 234*a*, 244*a*, 254*a* are cooperated with the corresponding passing holes 31 and 41 hermetically, the passing hole 31 and 41 do not affect the sealing effect.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An audio jack connector comprising:

an insulative housing comprising a mounting face, a receiving space, an insertion opening communicating with the receiving space, and a plurality of passageways extending from the mounting face along a bottom-to-up direction, a through hole defined in each of the passageways and communicating to the receiving space;

a plurality of contacts retained in corresponding passageways and extending into the receiving space through the through holes, each of the contacts includes a main portion, a connecting portion extending from the main portion, a contact portion extending from the connecting portion into the receiving space, and a soldering portion extending from the main portion through a gasket and a cover; and a sealing assembly assembled on the mounting face, the sealing assembly comprising the gasket covering on the mounting face for sealing the passageways and the cover assembled with the gasket to press and hold the gasket against the mounting face, the gasket having a plurality of passing holes each exposing the soldering portion of a corresponding one of the contacts.

2. The audio jack connector as claimed in claim 1, wherein the outer contour of the gasket and the outer contour of the cover are consistent with the outer contour of the mounting face.

3. The audio jack connector as claimed in claim 1, wherein the gasket is made of a waterproof material.

4. The audio jack connector as claimed in claim 1, wherein the cover is made of an elastically deformable rigid material.

5. The audio jack connector as claimed in claim 1, wherein the cover comprises a plurality of passing holes aligned with the passing holes of the gasket, respectively.

6. The audio jack connector as claimed in claim 5, wherein a plurality of fixing slots are defined on the insulative housing, and the cover includes a plurality of attaching members inserted into corresponding fixing slots.

7. The audio jack connector as claimed in claim 6, wherein the fixing slots are defined on the mounting face, the gasket includes a plurality of avoiding holes corresponding to the fixing slots, and the attaching members extend through corresponding avoiding holes to insert into the fixing slots.

8. The audio jack connector as claimed in claim 7, wherein a plurality of U-shaped gaps are defined on edges of the cover, and the attaching member extends upwardly from an inside edge of a corresponding U-shaped gap.

9. The audio jack connector as claimed in claim 1 wherein each of the passageways includes a fixing portion for fixing the main portion of the contact, a moving portion for receiving the connecting portion of the contact, and a through hole through which the contact portion of the contact extends into the receiving space.

10. The audio jack connector as claimed in claim 9, wherein the contact portion of the contact has a protrusion portion extending into the receiving space through the through hole.

11. The audio jack connector as claimed in claim 10, wherein a bottom surface of the soldering portion is within and parallel to the mounting face, and a soldering pin is defined on the bottom surface of the soldering portion and is downwardly extending beyond the mounting face.

12. An audio jack connector comprising:

an insulative housing comprising a mounting face, a receiving space along a front-to-back direction, an insertion opening communicating with the receiving space, and a plurality of passageways upwardly extending from the mounting face along a vertical direction perpendicular to said front-to-back direction, a through hole defined in each of the passageways and radially communicating to the receiving space;

a plurality of contacts upwardly assembled into and retained in corresponding passageways from the mounting face in the vertical direction, each of said contacts extending through the corresponding through hole and into the receiving space; and a sealing assembly assembled on the mounting face and comprising a vertically deformable gasket upwardly covering the mounting face for tightly sealing the passageways, and a cover upwardly assembled to the housing to tightly press and hold the gasket against the mounting face in said vertical direction; wherein said gasket forms a plurality of passing holes in the vertical direction, and each of said contacts includes a soldering pin extending through the corresponding passing hole and downwardly exposed to an exterior in said vertical direction.

13. The audio jack connector as claimed in claim 12, wherein the outer contour of the gasket and the outer contour of the cover are consistent with the outer contour of the mounting face.

14. The audio jack connector as claimed in claim 12, wherein the cover comprises a plurality of passing holes aligned with the passing holes of the gasket, respectively.

15. The audio jack connector as claimed in claim 14, wherein a plurality of fixing slots are defined on the insulative housing, and the cover includes a plurality of attaching members inserted into corresponding fixing slots.

16. The audio jack connector as claimed in claim 15, wherein the fixing slots are defined on the mounting face, the gasket includes a plurality of avoiding holes corresponding to the fixing slots, and the attaching members extend through corresponding avoiding holes to insert into the fixing slots.

17. The audio jack connector as claimed in claim 16, wherein a plurality of U-shaped gaps are defined on edges of the cover, and the attaching member extends upwardly from an inside edge of a corresponding U-shaped gap.

18. The audio jack connector as claimed in claim 12, wherein each of the contacts includes a main portion, a connecting portion extending from the main portion through the corresponding through hole, a contact portion extending from the connecting portion into the receiving space, and a soldering portion extending from the main portion with the corresponding soldering pin extending through the gasket and the cover.

* * * * *